US010351374B2

(12) United States Patent
Fukusaka

(10) Patent No.: US 10,351,374 B2
(45) Date of Patent: Jul. 16, 2019

(54) SHEET FEEDING DEVICE, IMAGE FORMING APPARATUS, SHEET FEEDING METHOD

(71) Applicant: CANON KABUSHIKI KAISHA, Tokyo (JP)

(72) Inventor: Tetsuro Fukusaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/830,396

(22) Filed: Dec. 4, 2017

(65) Prior Publication Data

US 2018/0162665 A1 Jun. 14, 2018

(30) Foreign Application Priority Data

Dec. 14, 2016 (JP) ..... 2016-242410

(51) Int. Cl.

| | |
|---|---|
| ***B65H 7/12*** | (2006.01) |
| ***G03G 15/00*** | (2006.01) |
| ***B65H 3/12*** | (2006.01) |
| ***B65H 1/04*** | (2006.01) |

(52) U.S. Cl.

CPC ..... *B65H 7/125* (2013.01); *B65H 1/04* (2013.01); *B65H 3/12* (2013.01); *B65H 3/128* (2013.01); *B65H 7/12* (2013.01); *G03G 15/6511* (2013.01); *G03G 15/703* (2013.01); *B65H 2553/30* (2013.01); *B65H 2801/03* (2013.01); *G03G 2215/00548* (2013.01); *G03G 2215/00637* (2013.01)

(58) Field of Classification Search

CPC ..... B65H 7/12; B65H 7/125; B65H 2553/30
See application file for complete search history.

(56) References Cited

U.S. PATENT DOCUMENTS

| | | | | |
|---|---|---|---|---|
| 5,185,520 A * | 2/1993 | Kurata | ..... | B65H 7/125 250/214 R |
| 6,481,705 B1 * | 11/2002 | Okada | ..... | B65H 7/125 271/262 |
| 7,591,459 B2 | 9/2009 | Matsumoto et al. | | |
| 8,210,519 B2 | 7/2012 | Fukusaka et al. | | |

(Continued)

FOREIGN PATENT DOCUMENTS

| | | | | |
|---|---|---|---|---|
| JP | 61051444 A * | 3/1986 | ..... | B65H 7/125 |
| JP | 02147546 A * | 6/1990 | ..... | B65H 7/125 |

(Continued)

*Primary Examiner* — Jeremy R Severson
(74) *Attorney, Agent, or Firm* — Venable LLP

(57) ABSTRACT

A sheet feeding device comprises sheet storage for storing a sheet, a merging conveying unit for feeding the sheet from the sheet storage to an image forming apparatus, a transmitting element for transmitting an ultrasonic signal to the sheet conveyed on the merging conveying unit, and a receiving element for receiving the ultrasonic signal having passed through the sheet and outputting an output signal according to strength of the received ultrasonic signal. When the sheet is a Japanese paper, the sheet feeding device detects double feeding of the sheet according to an average value of a plurality of the output signals and variation in a plurality of the output signals obtained for the one sheet. If the sheet is not double fed, the sheet is fed to the image forming apparatus. If the sheet is double fed, the sheet is discharged to the escape tray.

25 Claims, 10 Drawing Sheets

(56) References Cited

U.S. PATENT DOCUMENTS

| | | | | |
|---|---|---|---|---|
| 8,262,080 | B2 | 9/2012 | Matsumoto et al. | |
| 8,439,349 | B2 | 5/2013 | Matsumoto et al. | |
| 8,500,114 | B2 | 8/2013 | Matsumoto et al. | |
| 8,684,346 | B2 | 4/2014 | Yamazaki et al. | |
| 9,027,919 | B2 * | 5/2015 | Fukusaka | B41J 13/0009 271/111 |
| 9,156,644 | B2 * | 10/2015 | Harada | B65H 29/62 |
| 2006/0145412 | A1 * | 7/2006 | Tagawa | B65H 7/125 271/258.01 |

FOREIGN PATENT DOCUMENTS

| | | | | | |
|---|---|---|---|---|---|
| JP | 03023139 | A | * | 1/1991 | B65H 7/125 |
| JP | 2000-095390 | A | | 4/2000 | |
| JP | 2001063872 | A | * | 3/2001 | B65H 7/125 |
| JP | 2015-147659 | A | | 8/2015 | |

* cited by examiner

| | DATA 1 | DATA 2 | DATA 3 | DATA 4 | DATA 5 | DATA 6 | Max | Min | Ave | Max-Min |
|---|---|---|---|---|---|---|---|---|---|---|
| 1st SHEET | 1 | 7 | 5 | 3 | 9 | 1 | 9 | 1 | 4.3 | 8 |
| 2nd SHEET | 1 | 1 | 3 | 7 | 2 | 2 | 7 | 1 | 2.7 | 6 |
| 3rd SHEET | 3 | 3 | 1 | 0 | 0 | 0 | 3 | 0 | 1.2 | 3 |
| 4th SHEET | 1 | 1 | 0 | 3 | 3 | 2 | 3 | 0 | 1.7 | 3 |
| 5th SHEET | 1 | 5 | 4 | 1 | 1 | 1 | 5 | 1 | 2.2 | 4 |
| ⋮ | | | | | | | | | | |

FIG. 7A

| | DATA 1 | DATA 2 | DATA 3 | DATA 4 | DATA 5 | DATA 6 | Max | Min | Ave | Max-Min |
|---|---|---|---|---|---|---|---|---|---|---|
| 1st SHEET | 1 | 7 | 14 | 10 | 9 | 16 | 16 | 1 | 9.5 | 15 |
| 2nd SHEET | 1 | 14 | 13 | 7 | 9 | 11 | 14 | 1 | 9.2 | 13 |
| 3rd SHEET | 16 | 3 | 14 | 13 | 14 | 17 | 17 | 3 | 12.8 | 14 |
| 4th SHEET | 16 | 12 | 10 | 7 | 9 | 11 | 16 | 7 | 10.8 | 9 |
| 5th SHEET | 15 | 5 | 14 | 14 | 14 | 16 | 16 | 5 | 13 | 11 |
| ⋮ | | | | | | | | | | |

FIG. 7B

| | DATA 1 | DATA 2 | DATA 3 | DATA 4 | DATA 5 | DATA 6 | Max | Min | Ave | Max-Min |
|---|---|---|---|---|---|---|---|---|---|---|
| 1st SHEET | 21 | 20 | 20 | 20 | 20 | 20 | 21 | 20 | 20.2 | 1 |
| 2nd SHEET | 21 | 20 | 19 | 20 | 20 | 20 | 21 | 19 | 20 | 2 |
| 3rd SHEET | 21 | 20 | 19 | 20 | 19 | 19 | 21 | 19 | 19.7 | 2 |
| 4th SHEET | 22 | 21 | 20 | 20 | 20 | 19 | 22 | 19 | 20.3 | 3 |
| 5th SHEET | 21 | 21 | 19 | 20 | 19 | 19 | 21 | 19 | 19.8 | 2 |
| ⋮ | | | | | | | | | | |

FIG. 7C

| | DATA 1 | DATA 2 | DATA 3 | DATA 4 | DATA 5 | DATA 6 | Max | Min | Ave | Max-Min |
|---|---|---|---|---|---|---|---|---|---|---|
| 1st SHEET | 1 | 5 | 0 | 3 | 1 | 0 | 5 | 0 | 1.7 | 5 |
| 2nd SHEET | 2 | 0 | 0 | 1 | 5 | 3 | 5 | 0 | 1.8 | 5 |
| 3rd SHEET | 2 | 1 | 1 | 1 | 2 | 1 | 2 | 1 | 1.3 | 1 |
| 4th SHEET | 5 | 4 | 2 | 1 | 1 | 1 | 5 | 1 | 2.3 | 4 |
| 5th SHEET | 1 | 0 | 1 | 2 | 0 | 0 | 2 | 0 | 0.7 | 2 |
| ⋮ | | | | | | | | | | |

FIG. 8A

| | DATA 1 | DATA 2 | DATA 3 | DATA 4 | DATA 5 | DATA 6 | Max | Min | Ave | Max-Min |
|---|---|---|---|---|---|---|---|---|---|---|
| 1st SHEET | 15 | 5 | 7 | 3 | 13 | 10 | 15 | 3 | 8.8 | 12 |
| 2nd SHEET | 2 | 10 | 12 | 7 | 5 | 3 | 12 | 2 | 6.5 | 10 |
| 3rd SHEET | 2 | 12 | 14 | 1 | 2 | 1 | 14 | 1 | 5.3 | 13 |
| 4th SHEET | 5 | 7 | 2 | 0 | 13 | 9 | 13 | 0 | 6 | 13 |
| 5th SHEET | 12 | 10 | 4 | 4 | 5 | 7 | 12 | 4 | 7 | 8 |
| ⋮ | | | | | | | | | | |

FIG. 8B

| | DATA 1 | DATA 2 | DATA 3 | DATA 4 | DATA 5 | DATA 6 | Max | Min | Ave | Max-Min |
|---|---|---|---|---|---|---|---|---|---|---|
| 1st SHEET | 32 | 32 | 33 | 32 | 33 | 32 | 33 | 32 | 32.3 | 1 |
| 2nd SHEET | 32 | 32 | 32 | 33 | 33 | 32 | 33 | 32 | 32.3 | 1 |
| 3rd SHEET | 33 | 33 | 33 | 32 | 32 | 32 | 33 | 32 | 32.5 | 1 |
| 4th SHEET | 30 | 30 | 31 | 32 | 32 | 31 | 32 | 30 | 31 | 2 |
| 5th SHEET | 30 | 33 | 31 | 31 | 30 | 30 | 33 | 30 | 30.8 | 3 |
| ⋮ | | | | | | | | | | |

FIG. 8C

| | DATA 1 | DATA 2 | DATA 3 | DATA 4 | DATA 5 | DATA 6 | Max | Min | Ave | Max-Min |
|---|---|---|---|---|---|---|---|---|---|---|
| 1st SHEET | 32 | 32 | 18 | 23 | 19 | 32 | 32 | 18 | 26 | 14 |
| 2nd SHEET | 32 | 32 | 32 | 17 | 33 | 32 | 33 | 17 | 29.7 | 16 |
| 3rd SHEET | 33 | 28 | 24 | 32 | 32 | 32 | 33 | 24 | 30.2 | 9 |
| 4th SHEET | 16 | 19 | 31 | 32 | 32 | 31 | 32 | 16 | 26.8 | 16 |
| 5th SHEET | 30 | 20 | 19 | 31 | 30 | 30 | 31 | 19 | 26.7 | 12 |
| ⋮ | | | | | | | | | | |

FIG. 8D

SHEET FEEDING DEVICE, IMAGE FORMING APPARATUS, SHEET FEEDING METHOD

BACKGROUND OF THE INVENTION

Field of the Invention

The present disclosure relates to a sheet feeding device for feeding a sheet to an image forming apparatus such as a printer, a copying machine, and the like.

DESCRIPTION OF THE RELATED ART

The image forming apparatus performs image formation on a sheet which is fed one by one by a sheet feeding device. To feed the sheet one by one, some sheet feeding devices comprise a double feeding detection sensor which detects double feeding of the sheet. Japanese Patent Application Laid-open No. 2000-95390 discloses a double feeding detection method which detects the double feeding of the sheet by the double feeding detection sensor. The double feeding detection sensor includes an ultrasonic transmitting unit and an ultrasonic receiving unit which are arranged so as to sandwich a sheet conveyance path through which the sheet is conveyed. An output value which is output by the ultrasonic receiving unit according to an ultrasonic wave received from the ultrasonic transmitting unit when one sheet is conveyed is defined as a reference output value. A value which is lower than the reference output value is set as a threshold value for determining the double feeding. When the sheet is conveyed, the double feeding detection sensor scans the sheet in a conveying direction. During that time, in a case where a number of units with the output value of the ultrasonic receiving unit being lower than the threshold value exceeds a predetermined number, it is determined that the sheet is double fed. Japanese Patent Application Laid-open No. 2015-147659 discloses a double feeding detection method for determining the double feeding of the sheet according to variation (a difference between a maximum value and a minimum value, a variance value, a standard deviation) in an ultrasonic signal having passed through the sheet.

In the double feeding detection using the conventional sheet feeding device, even when determining the double feeding by at least one of the signal strength and its variation, as to the sheet with non-uniform fiber orientation (grain) and density such as a Japanese paper, a false detection may occur. This is because, in case of the sheet with the non-uniform fiber orientation and density such as the Japanese paper, depending on a detecting part of the sheet, even one sheet, the variation in the signal strength becomes large. The main subject of the present disclosure is to provide a sheet feeding device capable of accurately detecting the double feeding even when the sheet is a sheet with the non-uniform fiber orientation and density such as the Japanese paper.

SUMMARY OF THE INVENTION

A sheet feeding device according to the present disclosure includes: a sheet storage configured to store a sheet, a sheet feeder configured to feed the sheet stored in the sheet storage, a transmitter configured to transmit a signal to the sheet fed by the sheet feeder, a receiver configured to receive the signal which passes through the sheet and output an output signal according to strength of the received signal, and a controller configured to determine double feeding of the sheet fed by the sheet feeder according to an average value of values of a plurality of the output signals and variation in the values of the plurality of the output signals obtained for the one sheet if the sheet stored on the sheet storage is a first type sheet.

Further features of the present invention will become apparent from the following description of exemplary embodiments (with reference to the attached drawings).

BRIEF DESCRIPTION OF THE DRAWINGS

FIG. 7A, FIG. 7B, and FIG. 7C are explanatory diagrams of received data.

FIG. 8A, FIG. 8B, FIG. 8C, and FIG. 8D are explanatory diagrams of received data.

DESCRIPTION OF THE EMBODIMENTS

In the following, embodiments are described in detail with reference to the accompanying drawings.

Figure 1:
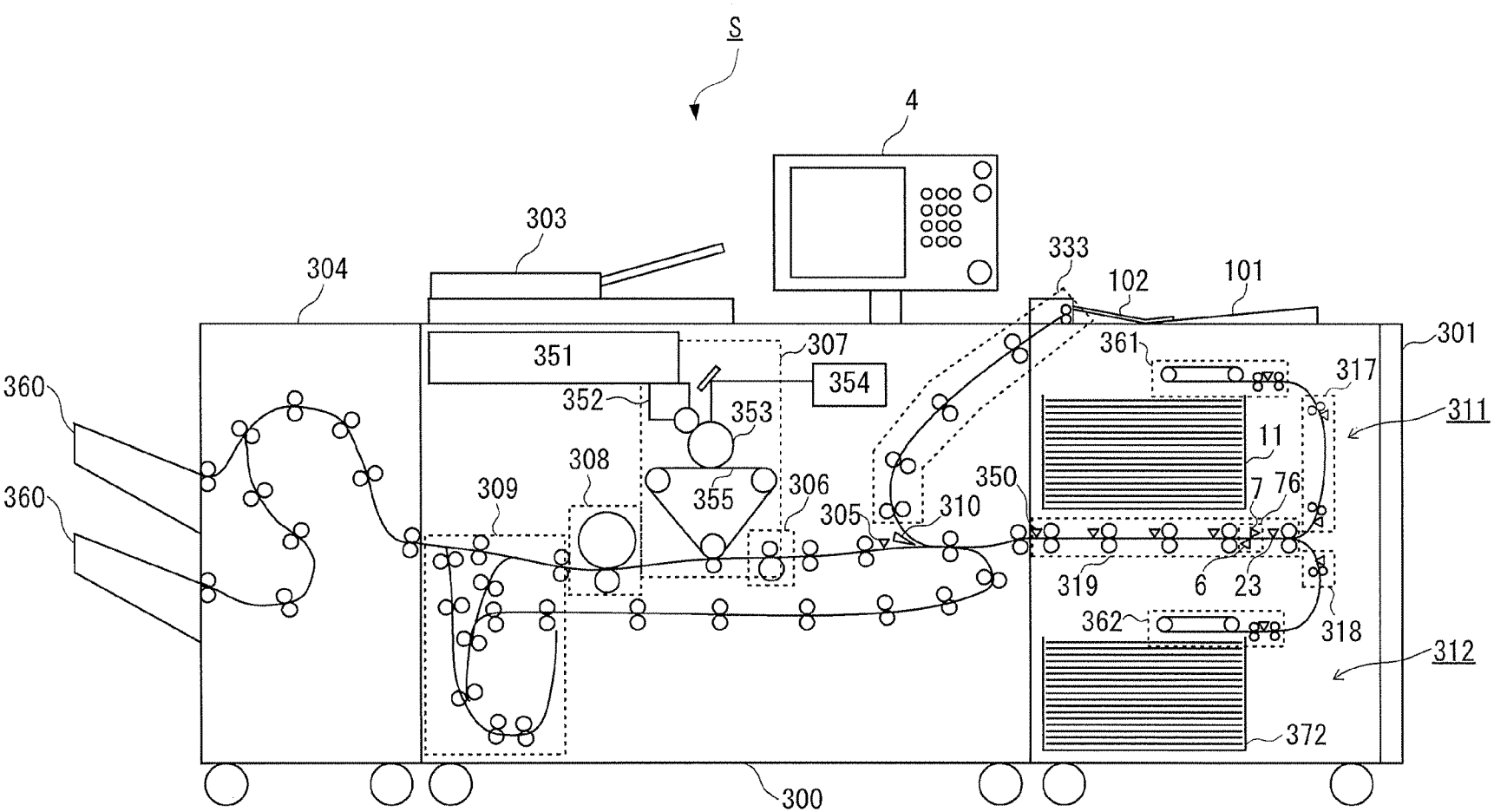
FIG. 1 is a configuration diagram of an image forming system.

FIG. 1 is a configuration diagram of an image forming system to which double feeding detection technology of the present embodiment is applied. An image forming system S comprises a sheet feeding device 301, an image forming apparatus 300, an operation unit 4, a reader scanner 303, and a post-processing device 304. A user performs setting of various processing (for example, sheet processing setting) to the image forming system S through the operation unit 4 or an external host computer (not shown). The operation unit 4 or the external host computer (not shown) functions as a reception part for receiving an operation input from the user. Further, image information to be processed is image data read by the reader scanner 303, image data sent from the external host computer, or the like. The image forming system S feeds and conveys the sheet, performs the image formation, performs the post-processing, and the like based on the sheet processing setting, the image information, and the like and outputs the sheet on which the image is formed as deliverables. In the following, a description is provided with regard to each configuration included in the image forming system S and a series of process flows of the image formation.

Sheet Feeding Device

The sheet feeding device 301 comprises a double feeding detection sensor 76, a sheet detection sensor 23, an escape tray 101, a full-stack detection sensor 102, an upper sheet feeder 311, a lower sheet feeder 312, an upper conveying unit 317, a lower conveying unit 318, and a merging conveying unit 319. The sheet feeding device 301 also comprises an escape conveying unit 333 and a conveyance sensor 350. An upper sheet feeder 311 comprises sheet storage 11 and a suction conveying unit 361. The lower part sheet feeder 312 comprises sheet storage 372 and a suction conveying unit 362. A double feeding detection sensor 76 consists of a transmitting element 6 and a receiving element 7.

The upper sheet feeder 311 feeds the sheet stored in the sheet storage 11. The lower sheet feeder 312 feeds the sheet stored in the sheet storage 372. The escape tray 101 is arranged on a top surface of the sheet feeding device 301. The double fed sheets (a plurality of overlapped sheets) are discharged from the escape tray 101. It means that the sheet which is discharged to the escape tray 101 is not conveyed to a secondary transfer position (described later). The full-stack detection sensor 102 detects whether the sheet discharged to the escape tray 101 is fully loaded or not.

Sheet feeding operation by the sheet storages 11 and 372 is started from the suction conveying units 361 and 362. It is noted that, in the present embodiment, a description is provided in case of air sheet feeding control as an example. Thereby, a plurality of fans (not shown) are arranged in each of the suction conveying units 361 and 362. Operation of the fans at the time of the sheet feeding operation is controlled so that air is sent between the sheets from upstream with respect to a conveying direction to the sheets stored in the sheet storages 11 and 372. When the sheet is separated by the air, it is sucked on an endless belt by a fan for sucking a sheet arranged inside the endless belt and then the sheet is fed and conveyed. Details of the sheet feeding and conveying operation by the suction conveying units 361 and 362 are described later.

The sheet which is fed from the upper sheet feeder 311 is conveyed to the merging conveying unit 319 where it merges with the lower sheet feeder 312 by the upper conveying unit 317. The sheet which is fed from the lower sheet feeder 312 is conveyed to the merging conveying unit 319 where it merges with the upper conveying unit 317 by the lower conveying unit 318. Though not shown, a stepping motor for conveyance is provided in each conveying unit. A driving force of the stepping motor provided in each conveying unit is mechanically transmitted so that a conveying roller of each conveying unit is rotated. Thus, the sheet conveyance is being performed.

The transmitting element 6 and the receiving element 7, consisting of the double feeding detection sensor 76, are arranged in the merging conveying unit 319. A conveyance path of the sheet is provided between the transmitting element 6 and the receiving element 7. The transmitting element 6 functions as a transmitter for transmitting the ultrasonic signal to the sheet. The receiving element 7 functions as a receiver for receiving the ultrasonic signal having passed through the sheet. Details of the double feeding detection sensor 76 are described later.

When receiving sheet feeding request notification from the image forming apparatus 300, which is a sheet feeding destination, the sheet feeding device 301 sequentially feeds and conveys the sheet stored in each of the sheet storages 11 and 372. The sheet feeding device 301 conveys the sheet to a conveyance sensor 350 positioned at a delivery portion to the image forming apparatus 300. When the conveyance sensor 350 detects the sheet, the sheet feeding device 301 notifies the image forming apparatus 300 of completion of preparation for delivery. The image forming apparatus 300 receives the notification of the completion of preparation for delivery from the sheet feeding device 301 and notifies a delivery request. The sheet feeding device 301 receives the notification of the delivery request and conveys the sheet one by one to the image forming apparatus 300 from the delivery portion. The sheet which is fed out from the sheet feeding device 301 is pulled out by the conveying roller of the image forming apparatus 300 at a time point when a front end of the sheet arrives at a nip of the conveying roller provided uppermost of the sheet conveyance path of the image forming apparatus 300 and is discharged from the sheet feeding device 301. When the sheet feeding device 301 conveys the number of sheets requested from the image forming apparatus 300, the sheet feeding device 301 ends the sheet feeding operation. When the sheet feeding device 301 ends the operation after the number of the requested sheets is pulled out by the image forming apparatus 300, it is turned into a standby state.

Image Forming Apparatus

The image forming apparatus 300 comprises an image reference sensor 305, a registration control unit 306, an image forming unit 307, a fixing unit 308, a reverse conveying unit 309, a flapper 310, a toner bottle 351, and a laser scanner unit 354. The image forming unit 307 comprises a developing unit 352, a photosensitive drum 353, and an intermediate transfer belt 355. As shown in FIG. 1, the operation unit 4 through which the user performs operation setting for the image forming system S and the reader scanner 303 for reading an original image are disposed on an upper part of the image forming apparatus 300.

The image forming apparatus 300 notifies the sheet feeding device 301 of the sheet feeding request. In addition, the image forming apparatus pulls out the sheet one by one from the sheet feeding device 301 and sequentially performs the image formation on the sheet. After receiving the sheet from the sheet feeding device 301, the image forming apparatus 300 controls each conveying unit to perform the sheet conveyance.

The flapper 310 is connected to a driving mechanism (not shown) and moves. The flapper 310 is positioned so that, when the double feeding detection sensor 76 detects the double feeding of the sheet, the sheet is conveyed to the escape tray 101. The flapper 310 is positioned so that, when the double feeding detection sensor 76 does not detect the double feeding of the sheet, the sheet is conveyed to the image forming unit 307. It means that, when the double feeding of the sheet is detected, the sheet is discharged to the escape tray 101. When the double feeding of the sheet is not detected, the image forming operation based on the image data is performed in the image forming unit 307 with sheet detection by the image reference sensor 305 as a starting point. It is noted that, in the present embodiment, a case where the escape conveying unit 333 for discharging the sheet to the escape tray 101 is arranged in the image forming apparatus 300 is illustrated. Not limited to this, for example, the escape conveying unit 333 may be arranged in the sheet feeding device 301.

The image forming apparatus 300 turns on and performs light control of semiconductor laser in the laser scanner unit 354. In addition, the image forming apparatus 300 controls a scanner motor which controls the rotation of a polygon mirror (not shown). Laser light which is emitted from the laser scanner unit 354 and is modulated by the image data is reflected by the rotating polygon mirror and scans a surface of the photosensitive drum 353. Thereby, a latent image is formed on the photosensitive drum 353. The image forming apparatus 300 supplies toner to the developing unit 352 from the toner bottle 351. The developing unit 352 develops the latent image on the photosensitive drum 353 with the toner. Thereby, a toner image is formed on the surface of the photosensitive drum 353. The toner image is transferred to the intermediate transfer belt 355 from the photosensitive drum 353. The toner image having transferred to the intermediate transfer belt 355 is transferred to the sheet. Thereby, the toner image is formed on the sheet.

The registration control unit 306 is arranged just before the secondary transfer position where the toner image is transferred to the sheet from the intermediate transfer belt 355 to a conveying direction of the sheet. The registration control unit 306 performs sheet conveyance control including screw correction to the sheet which is just before the secondary transfer position, fine adjustment of the front end position of the sheet to align with the toner image formed on the intermediate transfer belt 355 with the front end position of the sheet, and the like. By applying heat and pressure to the sheet after secondary transfer, the fixing unit 308 melts the toner and fixes the melted toner on the sheet. Thus, the image forming processing on the sheet is ended. The image-formed sheet is conveyed to the reverse conveying unit 309 when the image formation is continuously performed on its back surface or when reversing of front and back is necessary. When the image formation ends, the image-formed sheet is conveyed to the sheet feeding destination provided on downstream.

Post-Processing Device

The post-processing device 304 is one example of the sheet feeding destination provided on downstream of the image forming apparatus 300. The post-processing device 304 performs desired post-processing set by the user through the operation unit 4 (for example, fold, staple, punching, and the like). The post-processing device 304 discharges the sheet after the post-processing to any of the discharge trays 360 as the deliverables.

Sheet Feeding Unit

Figure 2:
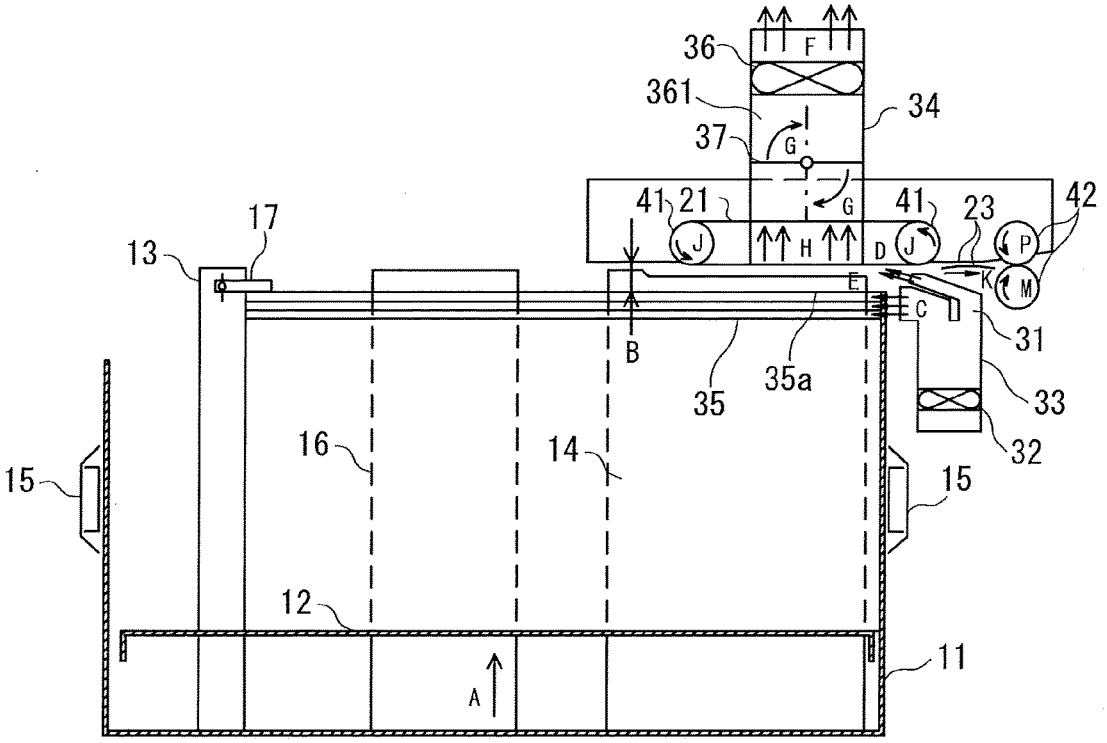
FIG. 2 is a configuration diagram of an upper sheet feeder.

FIG. 2 is a configuration diagram of the upper sheet feeder 311 of the sheet feeding device 301. The upper sheet feeder 311 mainly comprises the sheet storage 11, an air loosening unit 33, and the suction conveying unit 361. It is noted that the lower sheet feeder 312 has the same configuration with the upper sheet feeder 311. The sheet storage 11 comprises a tray 12 on which a plurality of sheets are placed, a rear end regulating plate 13 for regulating an upstream side in the conveying direction of the sheet (sheet rear end), a side end regulating plates 14 and 16 for regulating a direction orthogonal to the conveying direction (width direction), and a slide rail 15. It is noted that a sheet rear end pressing member 17 for pressing the sheet rear end is arranged on an upper part of the rear end regulating plate 13.

The user pulls out the sheet storage 11 from the sheet feeding device 301, sets the sheet in the sheet storage 11 and stores the sheet storage 11 at a predetermined position of the sheet feeding device 301. When a sensor (not shown) detects that the sheet storage 11 is stored at the predetermined position, a driving unit (not shown) starts to raise the tray 12 in an arrow A direction. Thereafter, when a sensor (not shown) detects that a distance to a suction conveying belt 21 becomes B, the tray 12 stops at that position.

The suction conveying unit 361 comprises a belt driving roller 41 for driving the suction conveying belt 21, a suction duct 34 for making a negative pressure space for sucking the sheet by the driving of the suction fan 36, and a suction shutter 37 for adjusting applying degree of the negative pressure in the suction duct 34. The sheet sucked on the suction conveying belt 21 is conveyed to a pulling-out roller pair 42 provided downstream in the conveying direction by the conveying force of the suction conveying belt 21.

The air loosening unit 33 comprises a loosening fan 32 and a loosening and separating duct 31. The loosening and separating duct 31 has a nozzle for spraying exhaust gas of the loosening fan 32 on a front end of the sheet as loosening air and separating air. The loosening and separating duct 31 sprays the loosening air in a direction C in FIG. 2 and sprays the separating air in a direction D in FIG. 2.

Figure 3A:
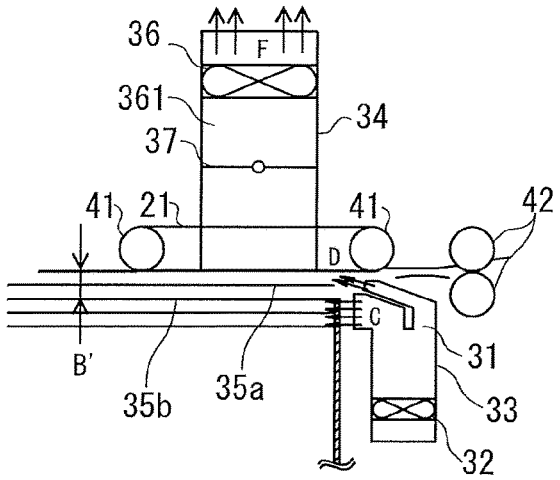
FIG. 3A, FIG. 3B, and FIG. 3C are explanatory diagrams of a sheet feeding method.
Figure 3B:
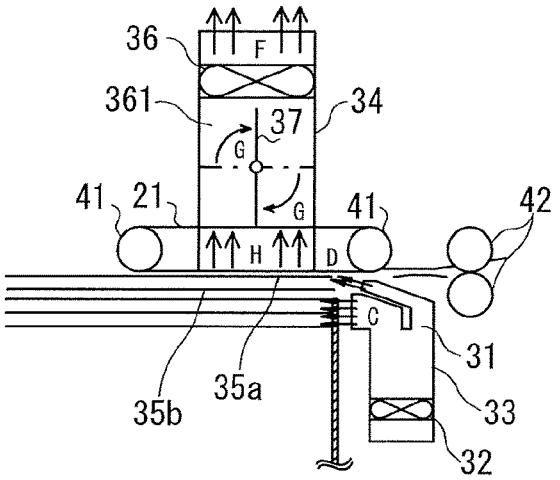
Figure 3C:
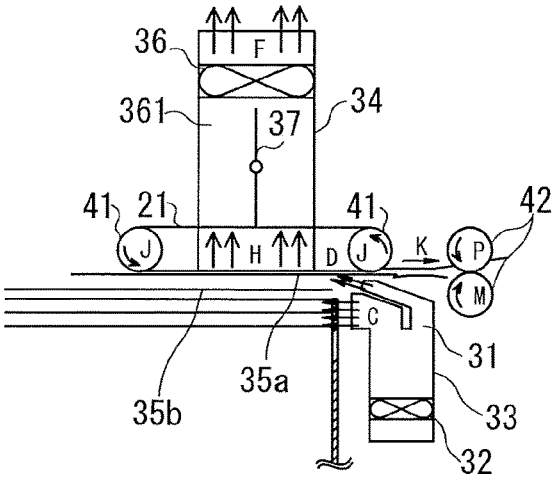

FIGS. 3A to 3C are explanatory diagrams of a sheet feeding method in the upper sheet feeder 311. FIG. 3A is an explanatory diagram at the start of the air loosening. FIG. 3B is an explanatory diagram when the sheet is sucked. FIG. 3C is an explanatory diagram at the start of the conveyance. It is noted that the lower sheet feeder 312 feeds the sheet in a similar method.

The sheet feeding device 301 receives a sheet feeding signal in a state in which the tray 12 stops at a position where a distance between an uppermost sheet 35*a* in the sheet storage 11 and the suction conveying belt 21 becomes B (refer to FIG. 2). In response to the reception of the sheet feeding signal, as shown in FIG. 3A, the sheet feeding device 301 drives the suction fan 36 of the suction conveying unit 361 to start air discharge in an arrow F direction. Thus, the negative pressure space is formed in the suction duct 34. Moreover, the sheet feeding device 301 drives the loosening fan 32 to spray the loosening air in a direction C in FIG. 3A. Further, the sheet feeding device 301 sprays the separating air in a direction D in FIG. 3A to start the air loosening.

The sheet feeding device 301 detects by a sensor (not shown), that, due to the air loosening, the distance between a paper surface position of the uppermost sheet 35*a* and the suction conveying belt 21 of the suction conveying unit 361 becomes B' (FIG. 3A). In response to the detection, as shown in FIG. 3B, the sheet feeding device 301 opens the suction shutter 37 disposed in the suction duct 34 in an arrow G direction by a driving unit (not shown). Thus, inner spaces of the suction duct 34 divided into two spaces through the suction shutter 37 become the negative pressure space. As a result, suction air for sucking the uppermost sheet 35*a* is generated in an arrow H direction. The uppermost sheet 35*a* is sucked on the suction conveying belt 21 in this way.

As shown in FIG. 3C, the sheet feeding device 301 rotates the belt driving roller 41 in an arrow J direction in a state in which the uppermost sheet 35*a* is sucked on the suction conveying belt 21. Thereby, the uppermost sheet 35*a* is conveyed in an arrow K direction. When the pulling-out roller pair 42 eventually rotates in an arrow M direction and an arrow P direction, respectively, the uppermost sheet 35*a* is conveyed to the next conveyance path.

Controller

Figure 4:
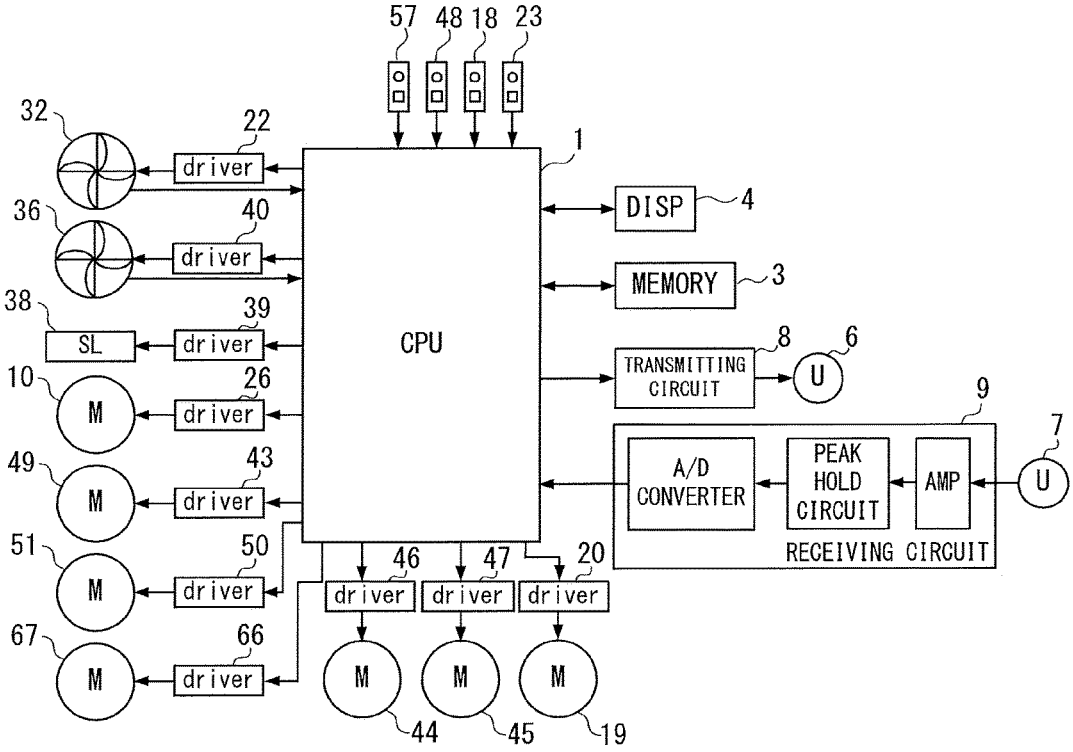
FIG. 4 is a block diagram showing a controller.

FIG. 4 is a block diagram showing a controller by each function unit of the sheet feeding device 301. The controller is incorporated in the sheet feeding device 301.

A CPU (Central Processing Unit) 1 functions as a control unit which controls operation of the sheet feeding device 301. The CPU 1 controls operation of a driving circuit which drives various loads such as various motors, fans, and the like of the sheet feeding device 301. The operation unit 4 (DISP) is a setting unit capable of inputting sheet information such as a sheet size, basis weight, a surface property and the like. A memory 3 is a storage unit for storing the sheet information input through the operation unit 4, various data, a PWM (pulse width modulation) value and a target value used for adjusting the fan.

Various sensors such as a sheet storage open/close sensor 48, a lower sheet surface detection sensor 57, an upper sheet surface detection sensor 18, a sheet detection sensor 23, and the like are connected to the CPU 1. The sheet storage open/close sensor 48 detects opening/closing state of the sheet storage 11. The lower sheet surface detection sensor 57 and the upper sheet surface detection sensor 18 detect an upper surface position of the sheet loaded on the tray 12. The sheet detection sensor 23 detects presence/absence of the sheet conveyed along the merging conveying unit 319. The CPU 1 monitors output of the various sensors.

The CPU 1 receives a rotational frequency signal (FG) of the loosening fan 32 and the suction fan 36 and performs PWM control of each fan so that each fan rotates at a target rotational frequency. To this end, a loosening fan driving circuit 22 and a suction fan driving circuit 40, both being drivers, are connected to the CPU 1. The loosening fan driving circuit 22 transmits the PWM signal output from the CPU 1 to the loosening fan 32. Also, the loosening fan driving circuit 22 supplies power to the loosening fan 32. The suction fan driving circuit 40 transmits the PWM signal output from the CPU 1 to the suction fan 36. Also, the suction fan driving circuit supplies power to the suction fan 36.

A suction solenoid driving circuit 39 is connected to the CPU 1. The suction solenoid driving circuit 39 is a driving circuit of a suction solenoid 38 which rotary drives to open and close the suction shutter 37.

A sheet feeding motor driving circuit 46, a pulling-out motor driving circuit 47, a lifter motor driving circuit 20, a lower part conveying motor driving circuit 26, an upper part conveying motor driving circuit 43, a merging conveying motor driving circuit 50, and an escape conveying motor driving circuit 66 are connected to the CPU 1. The sheet feeding motor driving circuit 46 is a driving circuit for driving the sheet feeding motor 44 which rotates the belt driving roller 41 of the suction conveying unit 361. The pulling-out motor driving circuit 47 is a driving circuit for driving a pulling-out motor 45 which rotates the pulling-out roller pair 42. The lifter motor driving circuit 20 is a driving circuit for driving a lifter motor 19 which is a lifter driving unit for elevating/lowering the tray 12. The lower unit conveying motor driving circuit 26 is a driving circuit for driving a lower unit conveying motor 10 which rotates the conveying roller of the lower conveying unit 318. The upper unit conveying motor driving circuit 43 is a driving circuit for driving an upper unit conveying motor 49 which rotates the conveying roller of the upper conveying unit 317. The merging conveying motor driving circuit 50 is a driving circuit for driving a merging conveying motor 51 which rotates the conveying roller of the merging conveying unit 319. The escape conveying motor driving circuit 66 is a driving circuit for driving an escape conveying motor 67 which rotates the conveying roller of the escape conveying unit 333.

A transmitting circuit 8 and a receiving circuit 9 of the double feeding detection sensor 76 are connected to the CPU 1. Through the control of the CPU 1, the transmitting circuit 8 generates a transmission signal and transmits the generated transmission signal to the transmitting element 6 of the double feeding detection sensor 76. The receiving circuit 9 receives an output signal, which is an analog signal, from the receiving element 7 of the double feeding detection sensor 76. The receiving circuit 9 comprises an amplification circuit (AMP) which amplifies the output signal, a peak hold circuit which holds a peak voltage of the amplified output signal, and an A/D converter which performs A/D conversion of the analog signal which is peak-held. The output signal which is A/D converted in the receiving circuit 9 is sent to the CPU 1. The CPU 1 determines whether the sheet is double fed or not according to the value corresponding to the output signal and the data such as the sheet information stored in the memory 3.

In the sheet feeding device 301 of the present embodiment, the description has been provided with regard to the configuration example in which the operation unit 4 and the memory 3 are directly connected to the CPU 1. Not limited to the configuration, the CPU 1 may, for example, be connected to the operation unit and the memory provided in the image forming apparatus 300. Further, instead of the sheet information input through the operation unit 4, the CPU 1 may use the sheet information automatically recognized by a sheet information detecting device provided in the sheet feeding device 301.

Double Feeding Detection Sensor

Figure 5:
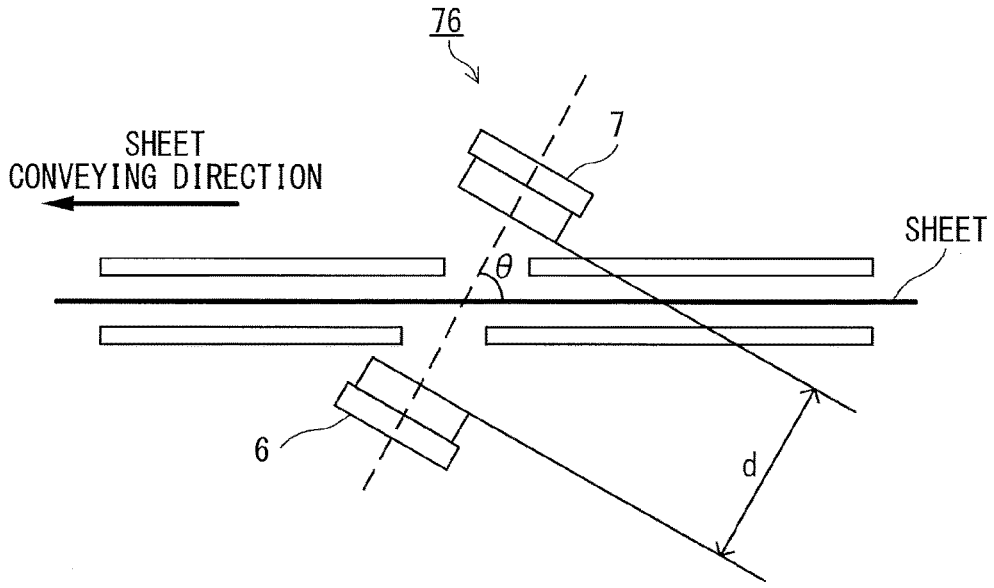
FIG. 5 is an explanatory diagram of an arrangement of a double feeding detection sensor.

FIG. 5 is an explanatory diagram of an arrangement of the transmitting element 6 and the receiving element 7 of the double feeding detection sensor 76. It is noted that, in the present embodiment, a description is provided assuming that the double feeding detection sensor 76 consisting of the transmitting element 6 and the receiving element 7 is an ultrasonic sensor. In the double feeding detection sensor 76, the transmitting element 6 and the receiving element 7 are arranged opposite to each other spaced by a distance d so that the transmitting element 6 is arranged at a lower side and the receiving element 7 is arranged at an upper side with the conveyance path of the sheet therebetween. Moreover, the transmitting element 6 and the receiving element 7 are arranged so that a transmission axis shown by a dotted line is inclined by an angle θ to the conveyance path of the sheet. The transmitting element 6 transmits the ultrasonic signal to the sheet. The receiving element 7 receives the ultrasonic signal transmitted from the transmitting element 6 and passed through the sheet. The receiving element 7 outputs the output signal which is the analog signal of a voltage value according to strength of the received ultrasonic signal. The conveyance path between the transmitting element 6 and the receiving element 7 becomes a detection position of the double feeding detection sensor 76.

Figure 6:
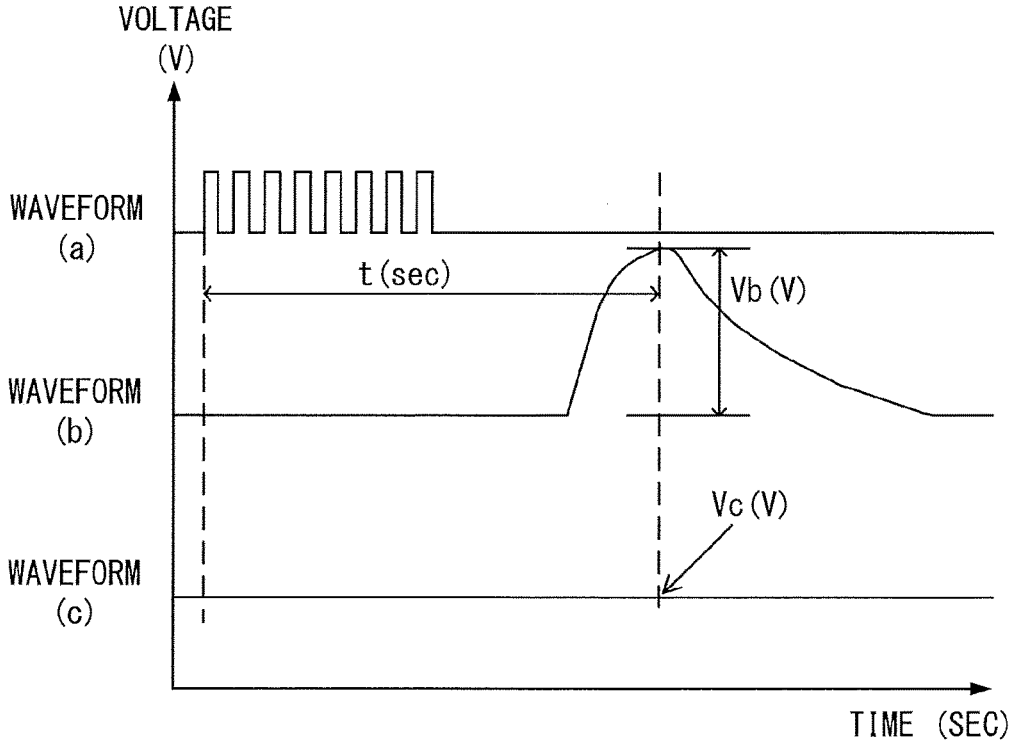
FIG. 6 is an explanatory diagram of input/output signal in the double feeding detection sensor.

FIG. 6 is an explanatory diagram of the input/output signal of the transmitting circuit 8 and the receiving circuit 9 in the double feeding detection sensor 76. It is noted that, in FIG. 6, the input/output signal is shown with a vertical axis as a voltage V and a lateral axis as a time (sec).

FIG. 6 shows the input/output signal when the sheet which passes through between the transmitting element 6 and the receiving element 7 is a plain sheet. The plain sheet means a sheet on a surface of which no special processing such as coating and the like is applied. A waveform (a) represents the input signal from the CPU 1 to the transmitting circuit 8. It shows an input of a burst wave of a predetermined voltage and a predetermined frequency by a predetermined number of pulses (here, 8 pulses) per one detection operation. A waveform (b) represents the output signal of the peak hold circuit of the receiving circuit 9 when the number of the sheets to be conveyed is one. A waveform (c) represents the output signal of the peak hold circuit of the receiving circuit 9 when two sheets are double fed.

An output signal voltage of the peak hold circuit of the receiving circuit 9 after a lapse of predetermined time t second from the pulse input to the transmitting circuit 8 becomes Vb V (waveform (b)) when the number of the sheets is one. Moreover, in case of the double feeding, the output signal voltage becomes Vc V (waveform (c)) which is approximately equal to 0 V. Comparing a case where the number of the sheet is one (non-double feeding) with a case where the sheet is double fed, a difference between the output signal voltages is very large. It means that, from a comparison result comparing these output signal voltages with a predetermined setting value (threshold value), it is possible to easily distinguish when the number of the sheets is one from when the sheet is double fed.

FIGS. 7A to 7C are explanatory diagrams of received data sent from the receiving element 7 of the double feeding detection sensor 76 to the CPU 1. The received data is data obtained by A/D converting the output signal voltage of the peak hold circuit (Vb, Vc) in the receiving circuit 9 after a lapse of the predetermined time t second from the input of the burst wave described in FIG. 6 to the transmitting circuit 8. In FIGS. 7A to 7C, a description is provided with regard to the received data when the sheet which passes through between the transmitting element 6 and the receiving element 7 is a coated thin paper having a coated surface property and basis weight of which is less than a predetermined value.

FIGS. 7A and 7B show the received data of two types of sheets with different tendency when the sheets are double fed (a state in which a plurality of sheets are overlappingly conveyed with no deviation) and operation values obtained from the received data. At the time of feeding the sheet, the sheet feeding device 301 inputs the burst wave described in FIG. 6 to the transmitting element 6 of the double feeding detection sensor 76 six times and receives six ultrasonic signals by the receiving element 7. The receiving element 7 transmits the output signal corresponding to the received six ultrasonic signals to the receiving circuit 9. The CPU 1 obtains six received data.

The burst wave is input to the transmitting element 6 six times so that the ultrasonic wave is transmitted at intervals of 20 milliseconds from a position 40 mm from the front end of the conveying direction of the sheet along an approximately center unit in a sheet width direction which is orthogonal to the conveying direction of the sheet. The six received data for the input of six burst waves are shown as "data 1 to data 6" in FIG. 7A. In FIG. 7A, the received data of a first sheet to a fifth sheet of the sheets to be fed are shown. Moreover, a maximum value (Max), a minimum value (Min), an average value (Ave), and a difference between the maximum value and the minimum value (Max−Min) of the six received data (data 1 to data 6) are shown for each sheet. The difference between the maximum value and the minimum value (Max−Min) is one of the parameters indicating variation in the received data. The received data of the first sheet which is double fed in FIG. 7A is "1", "7", "5", "3", "9", and "1" in order from the data 1, in which the maximum value is "9", the minimum value is "1", the average value is "4.3", and the difference between the maximum value and the minimum value is "8". The received data of the first sheet which is double fed in FIG. 7B is "1", "7", "14", "10", "9", and "16" in order from the data 1, in which the maximum value is "16", the minimum value is "1", the average value is "9.5", and the difference between the maximum value and the minimum value is "15". The received data is obtained by amplifying the output signal of the receiving element 7 by the receiving circuit 9 and A/D converting a peak-hold voltage value. The peak-hold voltage value of the received data becomes a value obtained by multiplying the received data described in FIGS. 7A to 7C by 20 mV.

FIG. 7C shows the received data when the sheet is not double fed and the operation value obtained from the received data. Similar to FIGS. 7A and 7B, in FIG. 7C, the six received data obtained by feeding one sheet is represented as "data 1 to data 6". Further, the maximum value (Max), the minimum value (Min), the average value (Ave), and the difference between the maximum value and the minimum value (Max−Min) of the six received data are shown for each sheet. For example, the received data of the first sheet is "21", "20", "20", "20", "20", and "20" in order from the data 1, in which the maximum value is "21", the minimum value is "20", the average value is "20.2", and the difference between the maximum value and the minimum value is "1".

In FIG. 7A, in the received data of the five conveyed sheets of the first to fifth sheets, the average value is equal to or less than 5. In FIG. 7B, in the received data of the five conveyed sheets which are double fed of the first to fifth sheets, the average value is equal to or more than 9, and the difference between the maximum value and the minimum value is within a range of "9 to 15". In FIG. 7C, in the received data of the five conveyed sheets of the first to fifth sheets, the average value is equal to or more than 19, and the difference between the maximum value and the minimum value is within a range of "1 to 3". Thus, the average value of the received data becomes smaller when the sheet is double fed than when the sheet is not double fed. The sheet used in FIG. 7B has the larger average value and the larger variation in the received data than the sheet used in FIG. 7A. According to FIG. 7C, the average value of the received data becomes larger and the variation becomes smaller when the sheet is not double fed than when the sheet is double fed.

The CPU 1 sets the threshold value for determining the double feeding to "8" for example to the average value of the received data (Ave). Further, the CPU 1 sets the threshold value for determining the double feeding to "5" for example to the difference between the maximum value and the minimum value (Max−Min). This enables the CPU 1 to detect the double feeding of the sheet when the average value of the received data is equal to or less than the threshold value "8" or when the difference between the maximum value and the minimum value is equal to or more than the threshold value "5". In a case other than this condition, the CPU 1 determines that the sheet is not double fed. Thus, the double feeding detection of the coated thin paper can surely be performed.

FIGS. 8A to 8D are explanatory diagrams of received data sent from the receiving element 7 of the double feeding detection sensor 76 to the CPU 1 by a particular type of sheet which is different from those in FIGS. 7A to 7C. The received data is data obtained by A/D converting the output signal voltage of the peak hold circuit (Vb, Vc) in the receiving circuit 9 after a lapse of the predetermined time t second from the input of the burst wave described in FIG. 6 to the transmitting circuit 8. In FIGS. 8A to 8D, a description is provided with regard to the received data when the sheet which passes through between the transmitting element 6 and the receiving element 7 is the Japanese paper with non-uniform fiber orientation and density depending on a unit on the sheet.

FIG. 8A represents the received data when the sheet is double fed and the operation values obtained from the received data. Similar to FIGS. 7A to 7C, at the time of feeding the sheet, the sheet feeding device 301 inputs the burst wave to the transmitting element 6 of the double feeding detection sensor 76 six times and receives six ultrasonic signals by the receiving element 7. The receiving element 7 transmits the output signal corresponding to the received ultrasonic signals of six inputs to the receiving circuit 9. The CPU 1 obtains received data of six inputs.

FIG. 8A represents the received data of the first to fifth sheets to be fed. Further, the maximum value (Max), the minimum value (Min), the average value (Ave), and the difference between the maximum value and the minimum value (Max−Min) of the received data of six inputs (data 1 to data 6) are shown for each sheet. The received data of the first sheet which is double fed in FIG. 8A is "1", "5", "0", "3", "1", and "0" in order from the data 1, in which the maximum value is "5", the minimum value is "0", the average value is "1.7", and the difference between the maximum value and the minimum value is "5". The received data is obtained by amplifying the output signal of the receiving element 7 by the receiving circuit 9 and A/D converting the peak-hold voltage value. The peak-hold voltage value of the received data becomes a value obtained by multiplying the received data described in FIGS. 8A to 8D by 20 mV.

FIGS. 8B, 8C, and 8D represent the received data when the sheet is not double fed and the operation values obtained from the received data. In FIGS. 8B, 8C, and 8D, the six received data obtained by feeding one sheet is represented as "data 1 to data 6". Further, the maximum value (Max), the minimum value (Min), the average value (Ave), and the difference between the maximum value and the minimum value (Max−Min) of the six received data (data 1 to data 6) are shown for each sheet. Similar to FIG. 8A, FIGS. 8B, 8C, and 8D represent the received data of the five conveyed sheets and the operation values.

The received data of the first sheet in FIG. 8B is "15", "5", "7", "3", "13", and "10" in order from the data 1, in which the maximum value is "15", the minimum value is "3", the average value is "8.8", and the difference between the maximum value and the minimum value is "12". The received data of the first sheet in FIG. 8C is "32", "32", "33", "32", "33", and "32" in order from the data 1, in which the maximum value is "33", the minimum value is "32", the average value is "32.3", and the difference between the maximum value and the minimum value is "1". The received data of the first sheet in FIG. 8D is "32", "32", "18", "23", "19", and "32" in order from the data 1, in which the maximum value is "32", the minimum value is "18", the average value is "26", and the difference between the maximum value and the minimum value is "14".

In FIG. 8A, in the received data of the five conveyed sheets of the first to fifth sheets, the average value is less than "3", and the difference between the maximum value and the minimum value is within a range of "1 to 5". In FIG. 8B, in the received data of the five conveyed sheets which are not double fed of the first to fifth sheets, the average value is equal to or more than 5 but less than 9 and the difference between the maximum value and the minimum value is within a range of "8 to 13". In FIG. 8C, in the received data of the five conveyed sheets which are not double fed of the first to fifth sheets, the average value is equal to or more than 30 but less than 33 and the difference between the maximum value and the minimum value is within a range of "1 to 3". In FIG. 8D, in the received data of the five conveyed sheets which are not double fed of the first to fifth sheets, the average value is equal to or more than 26 but less than 31 and the difference between the maximum value and the minimum value is within a range of "9 to 16". Thus, the average value of the received data becomes smaller and the variation in the received data also becomes smaller when the sheet is double fed than when the sheet is not double fed. The sheet used in FIG. 8B has the smaller average value of the received data and the larger variation in the received data than the sheets used in FIGS. 8C and 8D when the sheet is not double fed. The sheet used in FIG. 8C has the larger average value of the received data and the smaller variation in the received data than the sheets used in FIGS. 8B and 8D when the sheet is not double fed. The sheet used in FIG. 8D has the larger average value of the received data and the larger variation in the received data than the sheets used in FIG. 8B when the sheet is not double fed.

The CPU 1 sets the threshold value for determining the double feeding to "15" for example to the average value of the received data (Ave). Further, the CPU 1 sets the threshold value for determining the double feeding to "6" for example to the difference between the maximum value and the minimum value (Max−Min). This enables the CPU 1 to detect the double feeding of the sheet when the average value of the received data is equal to or less than the threshold value "15" or when the difference between the maximum value and the minimum value is equal to or less than the threshold value "6". In a case other than this condition, the CPU 1 determines that the sheet is not double fed. This enables to surely perform the double feeding detection of the Japanese paper. Unlike the contents as described in FIGS. 7A to 7C, when the sheet is the Japanese paper, even when the average value of the received data is equal to or less than the reference value, when the variation in the received data exceeds a predetermined value, it is determined that it is not the double feeding.

Sheet Feeding Processing

Figure 9:
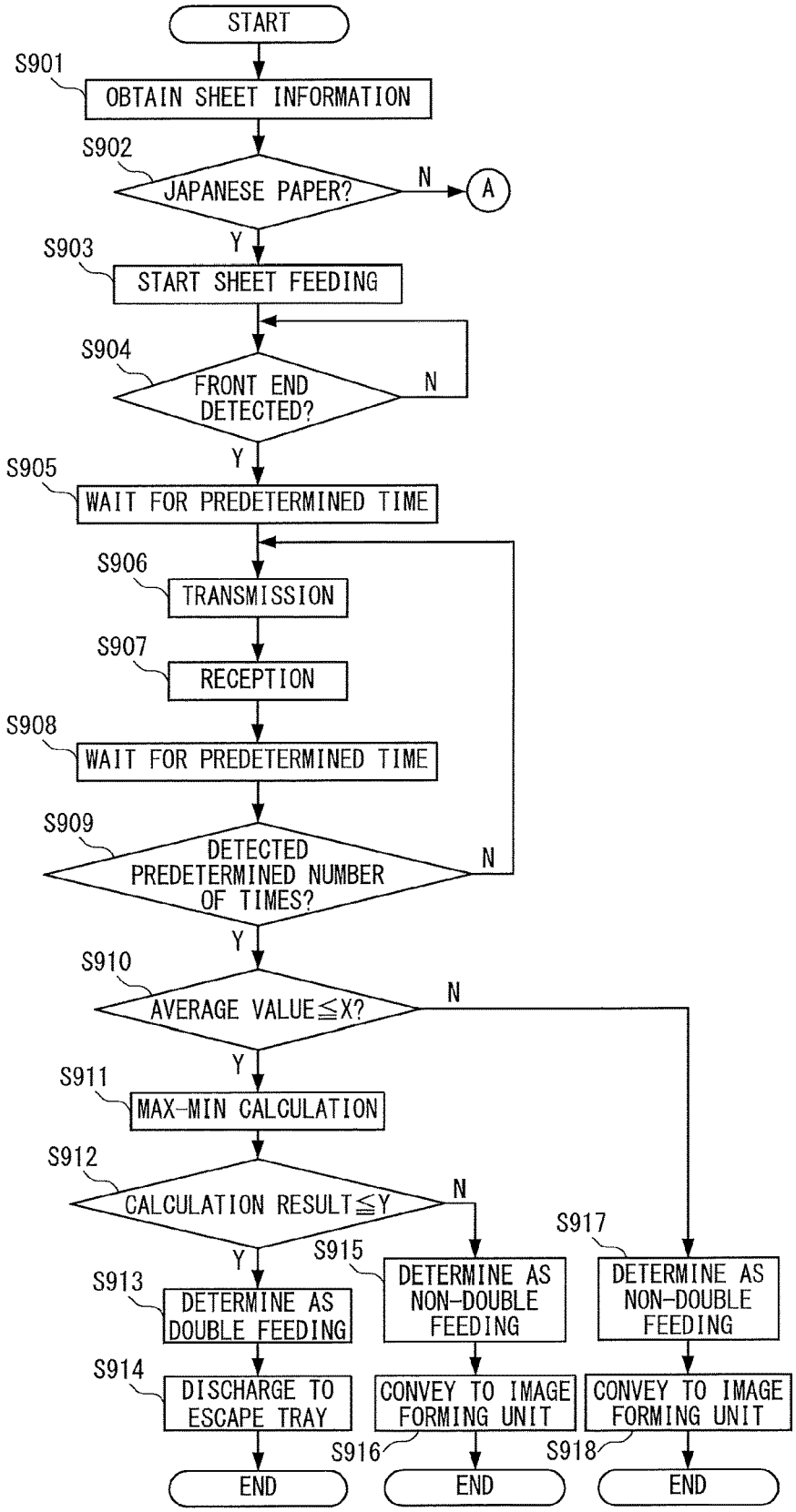
FIG. 9 is a flowchart showing sheet feeding processing.
Figure 10:
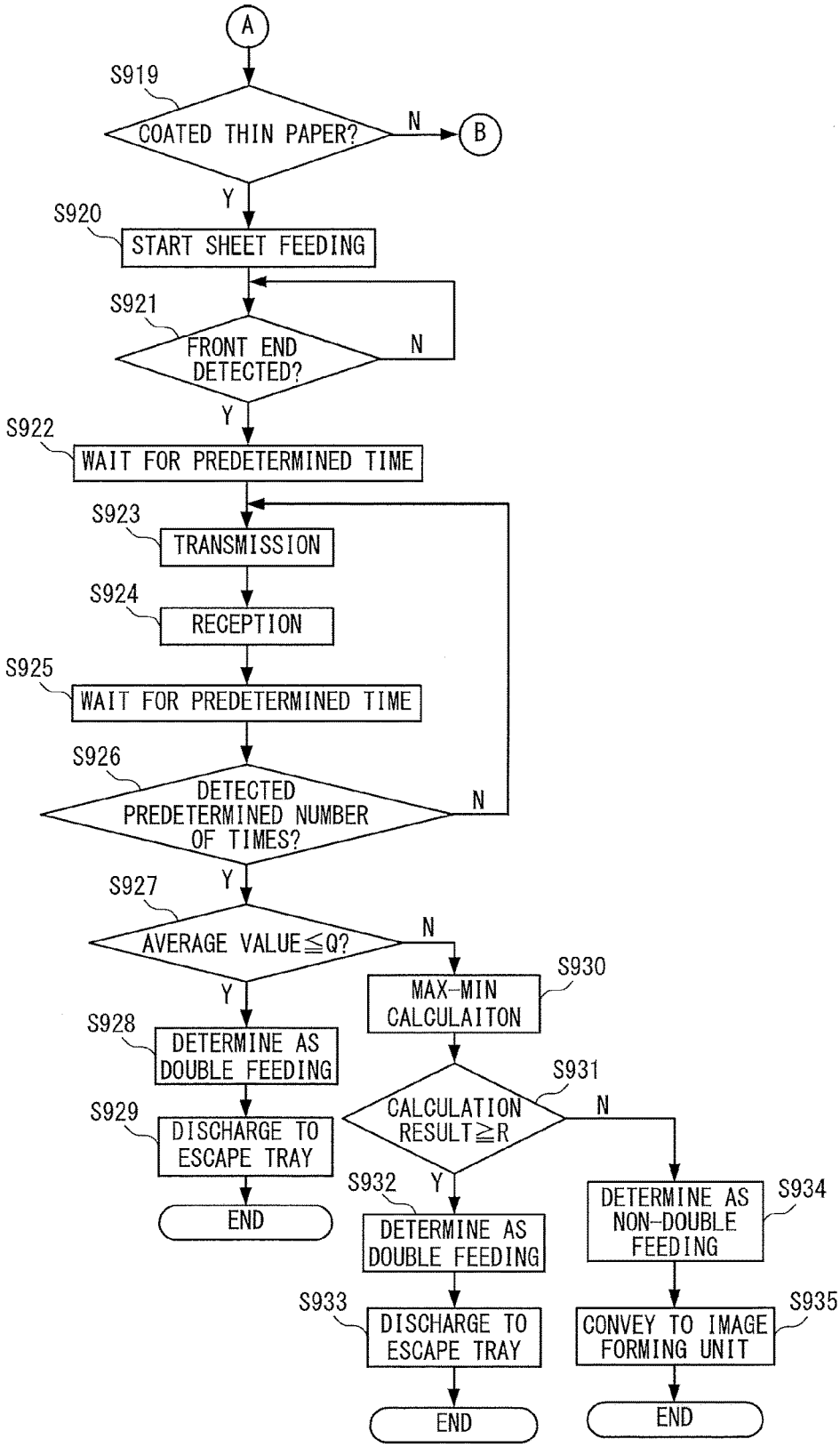
FIG. 10 is a flowchart showing the sheet feeding processing.
Figure 11:
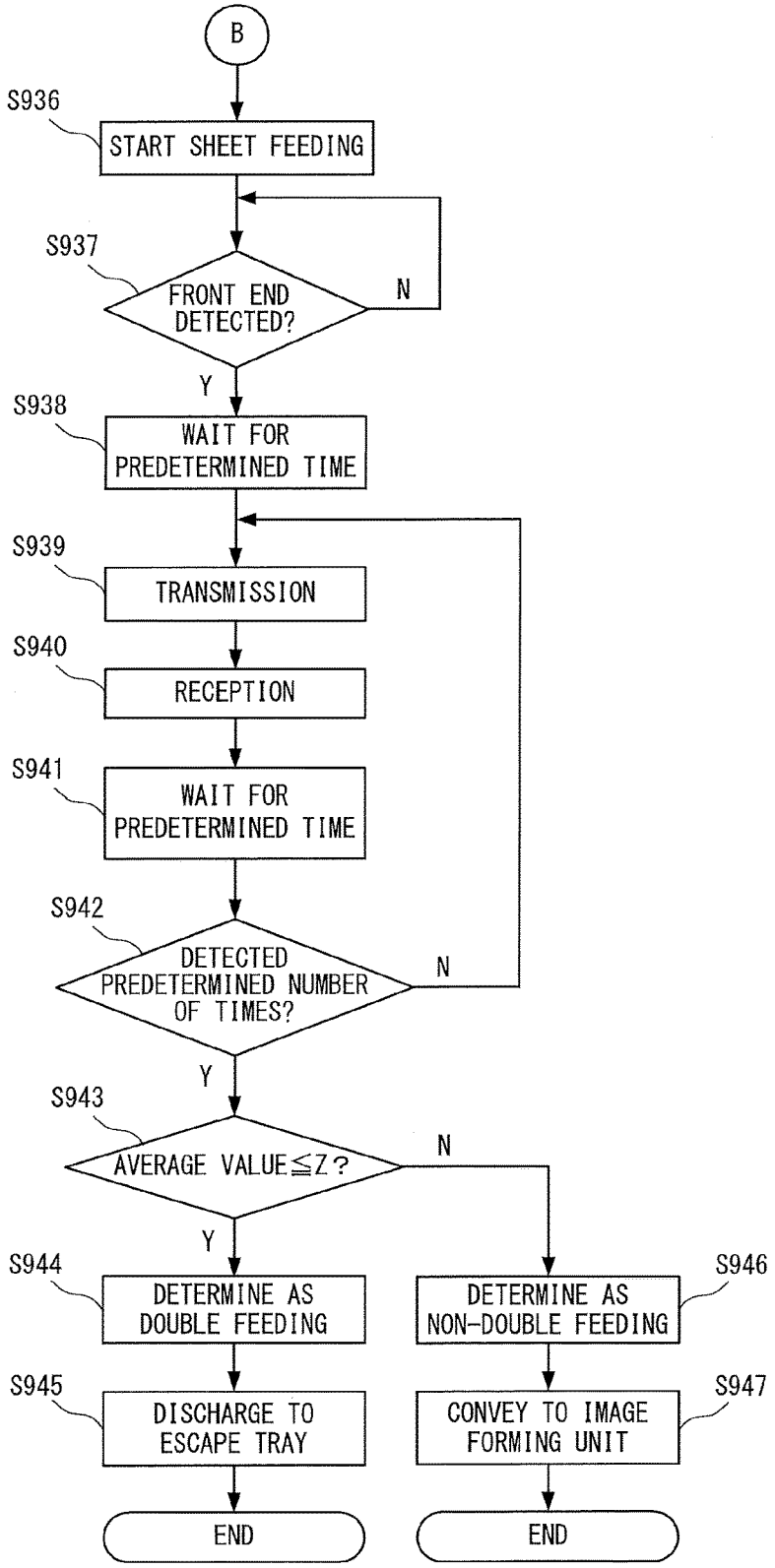
FIG. 11 is a flowchart showing the sheet feeding processing.

FIGS. 9, 10, and 11 are flowcharts representing the sheet feeding processing performed by the sheet feeding device 301. In this flowchart, a description is provided with regard to an example where the sheet is fed from the upper sheet feeder 311. Similar processing is performed when the sheet is fed from the lower sheet feeder 312. In response to the reception of the sheet feeding signal from the image forming apparatus 300, the sheet feeding device 301 executes the processing.

According to the sheet feeding signal, the CPU 1 obtains the sheet information of the sheet loaded in the sheet storage 11 which performs the sheet feeding (Step S901). The CPU 1 obtains the sheet information showing the type of the sheet which is previously input from the user through the operation unit 4 with reference to the memory 3. The sheet information includes the information regarding the type, the surface property and the basis weight of the sheet to be fed. The sheet information enables the CPU 1 to determine whether the sheet to be fed is the Japanese paper or not.

If it is determined that the type of the sheet to be fed is the Japanese paper (Step S902: Y), the CPU 1 starts the sheet feeding from the sheet storage 11 (Step S903). After the start of the sheet feeding, the CPU 1 monitors arrival of the front end of the sheet fed to the sheet detection sensor 23 by the sheet detection sensor 23 (Step S904). When the sheet detection sensor 23 detects the front end of the sheet fed (Step S904: Y), the CPU 1 stands by for a predetermined time until the sheet conveyed on the conveyance path arrives at the detecting position of the double feeding detection sensor 76 (Step S905).

When the sheet arrives at the detection position of the double feeding detection sensor 76, the CPU 1 causes the transmitting element 6 to transmit the ultrasonic signal (Step S906). By the transmission of the transmitting element 6, the CPU 1 obtains the received data corresponding to the output signal which is output from the receiving element 7 (Step S907). The CPU 1 stands by for a predetermined time after obtaining the received data (Step S908). The CPU 1 repeatedly performs the transmission of the ultrasonic signal to the sheet and the obtaining of the received data until it reaches a predetermined number of times required to determine a sheet status (Step S909: No). In the examples of FIGS. 7A to 7C and FIGS. 8A to 8D, the CPU 1 repeatedly performs the transmission of the ultrasonic signal and the reception of the received data six times. During this time, the sheet is being conveyed. Thus, the CPU 1 obtains the received data of a plurality of units in a conveying direction of the sheet to be conveyed.

After performing the transmission of the ultrasonic signal and the obtaining of the received data a predetermined number of times (Step S909: Y), the CPU 1 compares the average value of the obtained predetermined number of received data with a predetermined threshold value X (Step S910). In the examples of FIGS. 8A to 8D, the threshold value X for performing the double feeding determination of the sheet is set to "15".

If the average value is equal to or less than the threshold value X (Step S910: Y), the CPU 1 calculates the difference between the maximum value and the minimum value of the predetermined number of received data obtained (Max−Min) (Step S911). The difference between the maximum value and the minimum value of the received data (Max−Min) represents the variation in the received data or the variation in the output signal which is output from the receiving element 7. The CPU 1 compares the calculated variation with a predetermined threshold value Y (Step S912). In the examples of FIGS. 8A to 8D, the threshold value Y is set to "6" which is a value for performing the double feeding determination of the sheet. If the variation is equal to or less than the threshold value Y (Step S912: Y), the CPU 1 determines that the sheet which is being conveyed is double fed (Step S913). In this case, the CPU 1 selects the conveyance path so that the sheet is discharged to the escape tray 101. Thus, the sheet which is determined as the double feeding is discharged to the escape tray 101 (Step S914).

If the variation is larger than the threshold value Y (Step S912: N), the CPU 1 determines that the sheet which is being conveyed is not double fed (Step S915). In this case, the CPU 1 selects the conveyance path so that the sheet which is being conveyed is conveyed to the image forming unit 307 of the image forming apparatus 300. Thus, the sheet which is being conveyed is conveyed to the image forming unit 307 (Step S916).

If the average value is larger than the threshold value X (Step S910: N), the CPU 1 determines that the sheet which is being conveyed is not double fed (Step S917). In this case, the CPU 1 selects the conveyance path so that the sheet which is being conveyed is conveyed to the image forming unit 307 of the image forming apparatus 300. Thus, the sheet which is being conveyed is conveyed to the image forming unit 307 (Step S918).

If it is determined that the type of the sheet to be fed is not the Japanese paper (Step S902: N), the CPU 1 determines whether the sheet to be fed is the coated thin paper which has the coated surface property and the basis weight of which is less than a predetermined value based on the sheet information obtained (Step S919).

If it is determined that the type of the sheet to be fed is the coated thin paper (Step S919: Y), the CPU 1 starts the sheet feeding from the sheet storage 11 (Step S920). After starting the sheet feeding, the CPU 1 monitors the arrival of the sheet fed to the sheet detection sensor 23 by the sheet detection sensor 23 (Step S921). When the sheet detection sensor 23 detects the front end of the sheet fed (Step S921: Y), the CPU 1 stands by for a predetermined time until the sheet conveyed on the conveyance path arrives at the detecting position of the double feeding detection sensor 76 (Step S922).

When the sheet arrives at the detection position of the double feeding detection sensor 76, the CPU 1 causes the transmitting element 6 to transmit the ultrasonic signals (Step S923). By the transmission of the transmitting element 6, the CPU 1 obtains the received data corresponding to the output signal output from the receiving element 7 (Step S924). The CPU 1 stands by for a predetermined time after obtaining the received data (Step S925). The CPU 1 repeatedly performs the transmission of the ultrasonic signal to the sheet and the obtaining of the received data until it reaches a predetermined number of times required to determine a sheet status (Step S926: N). In the examples of FIGS. 7A to 7C and FIGS. 8A to 8D, the CPU 1 repeatedly performs the transmission of the ultrasonic signal and the reception of the received data six times. During this time, the sheet is being conveyed. Thus, the CPU 1 obtains the received data of a plurality of units in a conveying direction of the sheet to be conveyed.

After performing the transmission of the ultrasonic signal and the obtaining of the received data a predetermined number of times (Step S926: Y), the CPU 1 compares the average value of the obtained predetermined number of received data with a predetermined threshold value Q (Step S927). For example, in the examples of FIGS. 7A to 7C, the threshold value Q is "8", which becomes a reference value for determining whether the sheet is double fed or not.

If the average value is equal to or less than the threshold value Q (Step S927: Y), the CPU 1 determines that the sheet is double fed (Step S928). In this case, the CPU 1 selects the conveyance path so that the sheet is discharged to the escape tray 101. Thus, the sheet which is being conveyed is discharged to the escape tray 101 (Step S929).

If the average value is larger than the threshold value Q (Step S927: N), the CPU 1 calculates the variation which is the difference between the maximum value and the minimum value of the predetermined number of received data obtained (Max−Min) (Step S930). The CPU 1 compares the calculated variation with a predetermined threshold value R (Step S931). In the examples of FIGS. 7A to 7C, the threshold value R for performing the double feeding determination of the sheet is set to "5". If the variation is equal to or more than the threshold value R (Step S931: Y), the CPU 1 determines that the sheet which is being conveyed is double fed (Step S932). In this case, the CPU 1 selects the conveyance path so that the sheet is discharged to the escape tray 101. Thereby, the sheet which is being conveyed is discharged to the escape tray 101 (Step S933).

If the variation is smaller than the threshold value R (Step S931: N), the CPU 1 determines that the sheet which is being conveyed is not double fed (Step S934). In this case, the CPU 1 selects the conveyance path so that the sheet which is being conveyed is conveyed to the image forming unit 307 of the image forming apparatus 300. Thus, the sheet which is being conveyed is conveyed to the image forming unit 307 (Step S935).

If it is determined that the type of the sheet to be fed is not the coated thin paper (Step S919: N), the CPU 1 starts the sheet feeding from the sheet storage 11 (Step S936). After starting the sheet feeding, the CPU 1 monitors the arrival of the front end of the sheet fed to the sheet detection sensor 23 by the sheet detection sensor 23 (Step S937). When the sheet detection sensor 23 detects the front end of the sheet fed (Step S937: Y), the CPU 1 stands by for a predetermined time until the sheet conveyed on the conveyance path arrives at the detecting position of the double feeding detection sensor 76 (Step S938).

When the sheet arrives at the detection position of the double feeding detection sensor 76, the CPU 1 causes the transmitting element 6 to transmit the ultrasonic signal (Step S939). By the transmission of the transmitting element 6, the CPU 1 obtains the received data corresponding to the output signal output from the receiving element 7 (Step S940). The CPU 1 stands by for a predetermined time after obtaining the received data (Step S941). The CPU 1 repeatedly performs the transmission of the ultrasonic signal to the sheet and the obtaining of the received data until it reaches a predetermined number of times required to determine a sheet status (Step S942: N). In the examples of FIGS. 7A to 7C and FIGS. 8A to 8D, the CPU 1 repeatedly performs the transmission of the ultrasonic signal and the reception of the received data six times. During this time, the sheet is being conveyed. Thus, the CPU 1 obtains the received data of a plurality of units in a conveying direction of the sheet to be conveyed.

After performing the transmission of the ultrasonic signal and the obtaining of the received data predetermined number of times (Step S942: Y), the CPU 1 compares the average value of the obtained predetermined number of received data with a predetermined threshold value Z (Step S943). For example, the threshold value Z is set to a value corresponding to a voltage between Vb and Vc in FIG. 6.

If the average value is equal to or less than the threshold value Z (Step S943: Y), the CPU 1 determines that the sheet is double fed (Step S944). In this case, the CPU 1 selects the conveyance path so that the sheet is discharged to the escape tray 101. Thus, the sheet which is being conveyed is discharged to the escape tray 101 (Step S945).

If the average value is larger than the threshold value Z (Step S943: N), the CPU 1 determines that the sheet which is being conveyed is not double fed (Step S946). In this case, the CPU 1 selects the conveyance path so that the sheet which is being conveyed is conveyed to the image forming unit 307 of the image forming apparatus 300. Thus, the sheet which is being conveyed is conveyed to the image forming unit 307 (Step S947).

Through the above mentioned processing, it is determined whether the sheet is double fed or not. When the sheet is double fed, the sheet is not fed to the image forming apparatus 300. Instead, the sheet is discharged. Even when the type of the sheet such as the Japanese paper with different density and fiber orientation depending on a unit on the sheet and with difficulty in determining the double feeding is fed, by performing the double feeding determination based on the average value of the received data and the variation in the received data, it is possible to suppress possibility of wrongly detecting the double feeding.

In the present embodiment, when the average value of the received data is equal to or less than the reference value (threshold value X), by comparing the variation in the received data (Max−Mix) with the set value (threshold value Y), the double feeding of the Japanese paper is determined. This determination method suppresses the possibility to wrongly detect the double feeding of the Japanese paper. It means that, when conveying one Japanese paper, the possibility of determining the conveyance as the double feeding is suppressed. Moreover, it is possible to surely determine the double feeding for a particular type of sheet (Japanese paper).

It is noted that, through the above processing, the received data is obtained at a plurality of units of the sheet being conveyed and the difference between the maximum value and the minimum value of the received data is used as the variation in the received data; however, a variance value, a standard deviation, and the like may be used instead for the variation. Further, the average value of the receive data is compared with the threshold values X, Q, Z at a plurality of units of the sheet being conveyed. However, by using a predetermined value such as the maximum value and the minimum value of the received data other than the average value, a similar effect can be obtained through the similar processing. The sheet feeding device 301 may be integrated in the image forming apparatus 300.

As mentioned, in the present embodiment, the double feeding determination is performed according to a predetermined value and variation in a plurality of output signals. Thereby, even with the sheet with the non-uniform fiber orientation and density such as the Japanese paper, it becomes possible to accurately detect the double feeding.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

Embodiment(s) of the present invention can also be realized by a computer of a system or apparatus that includes one or more circuits (e.g., application specific integrated circuit (ASIC) or SOC (system on a chip)) for performing the functions of one or more of the above-described embodiment(s).

This application claims the benefit of Japanese Patent Application No. 2016-242410, filed Dec. 14, 2016 which is hereby incorporated by reference herein in its entirety.

What is claimed is:

1. A sheet feeding device comprising:

a sheet storage configured to store a sheet;

a sheet feeder configured to feed the sheet stored in the sheet storage;

a transmitter configured to transmit a signal to the sheet fed by the sheet feeder;

a receiver configured to receive the signal which passes through the sheet and output an output signal according to a strength of the received signal;

a memory configured to store sheet information representing a type of a sheet stored in the sheet storage; and a controller, in a case where the sheet stored in the sheet storage is determined to be a predetermined type based on the sheet information, configured to determine double feeding of the sheet fed by the sheet feeder by comparing a first threshold value (X) associated with the predetermined type with an average value of values of a plurality of the output signals obtained by the receiver and comparing a second threshold value (Y) associated with the predetermined type with variation in the values of the plurality of the output signals.

2. The sheet feeding device according to claim 1, further comprising:

an escape conveying unit configured to discharge the sheet to a tray which is different from a target position, wherein the controller is further configured to cause the conveying unit to convey a sheet which is determined to be double fed to the escape conveying unit and convey a sheet which is not double fed to the target position.

3. The sheet feeding device according to claim 1, wherein the predetermined type of sheet is a sheet with non-uniform fiber orientation and density.

4. The sheet feeding device according to claim 1, wherein the transmitter is configured to transmit an ultrasonic signal to the sheet fed by the sheet feeder, and wherein the receiver is configured to receive the ultrasonic signal which passes through the sheet and output the output signal of a voltage value according to strength of the received ultrasonic signal.

5. The sheet feeding device according to claim 1,
wherein the variation is a difference between a maximum value and a minimum value of the plurality of the output signals.

6. A sheet feeding device comprising:
a sheet storage configured to store a sheet;
a sheet feeder configured to feed the sheet stored in the sheet storage;
a transmitter configured to transmit a signal to the sheet fed by the sheet feeder;
a receiver configured to receive the signal which passes through the sheet and output an output signal according to a strength of the received signal; and
a controller configured to determine double feeding of the sheet fed by the sheet feeder according to an average value of values of a plurality of the output signals and variation in the values of the plurality of the output signals obtained for the one sheet if the sheet stored in the sheet storage is a predetermined type of sheet,
wherein the variation is a variance value of the plurality of the output signals.

7. The sheet feeding device according to claim 6,
wherein the predetermined type of sheet is a sheet with non-uniform fiber orientation and density.

8. The sheet feeding device according to claim 6,
wherein the transmitter is configured to transmit an ultrasonic signal to the sheet fed by the sheet feeder, and
wherein the receiver is configured to receive the ultrasonic signal which passes through the sheet and output the output signal of a voltage value according to the strength of the received ultrasonic signal.

9. The sheet feeding device according to claim 6,
wherein the variation is a difference between a maximum value and a minimum value of the plurality of the output signals.

10. A sheet feeding device comprising:
a sheet storage configured to store a sheet;
a sheet feeder configured to feed the sheet stored in the sheet storage;
a transmitter configured to transmit a signal to the sheet fed by the sheet feeder;
a receiver configured to receive the signal which passes through the sheet and output an output signal according to a strength of the received signal; and
a controller configured to determine double feeding of the sheet fed by the sheet feeder according to an average value of values of a plurality of the output signals and variation in the values of the plurality of the output signals obtained for the one sheet if the sheet stored in the sheet storage is a predetermined type of sheet,
wherein the variation is a standard deviation of the plurality of the output signals.

11. The sheet feeding device according to claim 10,
wherein the predetermined type of sheet is a sheet with non-uniform fiber orientation and density.

12. The sheet feeding device according to claim 10,
wherein the transmitter is configured to transmit an ultrasonic signal to the sheet fed by the sheet feeder, and
wherein the receiver is configured to receive the ultrasonic signal which passes through the sheet and output the output signal of a voltage value according to the strength of the received ultrasonic signal.

13. The sheet feeding device according to claim 10,
wherein the variation is a difference between a maximum value and a minimum value of the plurality of the output signals.

14. A sheet feeding device comprising:
a sheet storage configured to store a sheet;
a sheet feeder configured to feed the sheet stored in the sheet storage;
a transmitter configured to transmit a signal to the sheet fed by the sheet feeder;
a receiver configured to receive the signal which passes through the sheet and output an output signal according to a strength of the received signal; and
a controller configured to determine double feeding of the sheet fed by the sheet feeder according to an average value of values of a plurality of the output signals and variation in the values of the plurality of the output signals obtained for the one sheet if the sheet stored in the sheet storage is a first type of sheet,
wherein the controller is further configured to detect double feeding of the sheet fed by the sheet feeder based on the average value of values of the plurality of the output signals without using variation in the plurality of the output signals if the sheet stored in the sheet storage is a second type of sheet.

15. The sheet feeding device according to claim 14,
wherein the first type of sheet is a sheet with non-uniform fiber orientation and density.

16. The sheet feeding device according to claim 14,
wherein the transmitter is configured to transmit an ultrasonic signal to the sheet fed by the sheet feeder, and
wherein the receiver is configured to receive the ultrasonic signal which passes through the sheet and output the output signal of a voltage value according to the strength of the received ultrasonic signal.

17. The sheet feeding device according to claim 14,
wherein the variation is a difference between a maximum value and a minimum value of the plurality of the output signals.

18. An image forming apparatus comprising:
a sheet storage configured to store a sheet;
an image forming unit configured to perform image formation on the sheet;
a sheet feeder configured to feed the sheet stored in the sheet storage to the image forming unit;
a conveying unit configured to further convey the sheet fed by the sheet feeder;
a transmitter configured to transmit a signal to the sheet fed by the sheet feeder;
a receiver configured to receive the signal which passes through the sheet and output an output signal according to a strength of the received signal;
a storage unit configured to store sheet information representing a type of the sheet stored in the sheet storage;
an escape conveying unit configured to discharge the sheet to a tray which is different from a tray to which a sheet on which an image is formed by the image forming unit is discharged; and
a controller configured to determine double feeding of the sheet fed by the sheet feeder according to an average value of values of a plurality of the output signals and variation in the values of the plurality of the output signals obtained for the one sheet if the type of the sheet represented by the sheet information is a predetermined type and causes the conveying unit to convey the sheet to the escape conveying unit if the sheet is double fed and convey the sheet to the image forming unit if the sheet is not double fed.

19. The image forming apparatus according to claim 18,
wherein the predetermined type of sheet is a sheet with non-uniform fiber orientation and density.

20. The image forming apparatus according to claim 18, wherein the transmitter is configured to transmit an ultrasonic signal to the sheet fed by the sheet feeder, and wherein the receiver is configured to receive the ultrasonic signal which passes through the sheet and output the output signal of a voltage value according to the strength of the received ultrasonic signal.

21. The image forming apparatus according to claim 18, wherein the variation is a difference between a maximum value and a minimum value of the plurality of the output signals.

22. A sheet feeding method executed by a device comprising:

a sheet storage configured to store a sheet;

an image forming unit configured to perform image formation on the sheet, a sheet feeder configured to feed the sheet stored in the sheet storage to the image forming unit;

a conveying unit configured to further convey the sheet fed by the sheet feeder;

a transmitter configured to transmit a signal to the sheet fed by the sheet feeder;

a receiver configured to receive the signal which passes through the sheet and output an output signal according to a strength of the received signal; and an escape conveying unit configured to discharge the sheet to a tray which is different from a tray to which a sheet on which an image is formed by the image forming unit is discharged, the method comprising:

storing sheet information in a memory, the sheet information representing a type of a sheet previously stored in the sheet storage;

calculating an average value of values of a plurality of the output signals and variation in the values of the plurality of the output signals obtained for the one sheet if the type of the sheet represented by the sheet information is a first predetermined type;

detecting double feeding of the sheet fed by the sheet feeder according to the average value and the variation calculated;

conveying the sheet to the escape conveying unit by the conveying unit if the sheet is double fed; and conveying the sheet to the image forming unit by the conveying unit if the sheet is not double fed.

23. The sheet feeding method according to claim 22, wherein the predetermined type of sheet is a sheet with non-uniform fiber orientation and density.

24. The sheet feeding method according to claim 22, wherein the transmitter is configured to transmit an ultrasonic signal to the sheet fed by the sheet feeder, and wherein the receiver is configured to receive the ultrasonic signal which passes through the sheet and output the output signal of a voltage value according to the strength of the received ultrasonic signal.

25. The sheet feeding method according to claim 22, wherein the variation is a difference between a maximum value and a minimum value of the plurality of the output signals.

* * * * *